US011353910B1

(12) United States Patent
Wadhwa et al.

(10) Patent No.: US 11,353,910 B1
(45) Date of Patent: Jun. 7, 2022

(54) BANDGAP VOLTAGE REGULATOR

(71) Applicant: NXP B.V., Eindhoven (NL)

(72) Inventors: Sanjay Kumar Wadhwa, Noida (IN); Ricardo Pureza Coimbra, Campinas (BR); Jaideep Banerjee, Noida (IN)

(73) Assignee: NXP B.V., San Jose, CA (US)

( * ) Notice: Subject to any disclaimer, the term of this patent is extended or adjusted under 35 U.S.C. 154(b) by 0 days.

(21) Appl. No.: 17/302,399

(22) Filed: Apr. 30, 2021

(51) Int. Cl.
*G05F 3/26* (2006.01)

(52) U.S. Cl.
CPC ..... *G05F 3/265* (2013.01)

(58) Field of Classification Search
None
See application file for complete search history.

(56) References Cited

U.S. PATENT DOCUMENTS

| | | | | |
|---|---|---|---|---|
| 4,064,448 | A | 12/1977 | Eatock | |
| 6,175,224 | B1 | 1/2001 | Kadanka | |
| 9,030,186 | B2 | 5/2015 | Gupta et al. | |
| 9,213,349 | B2 | 12/2015 | Hu et al. | |
| 9,594,391 | B2 | 3/2017 | De Cremoux | |
| 9,780,652 | B1 | 10/2017 | Far | |
| 9,791,875 | B1 | 10/2017 | Wang | |
| 9,804,615 | B2 * | 10/2017 | Chern | G05F 1/468 |
| 10,203,715 | B2 * | 2/2019 | Liou | G05F 3/30 |
| 10,520,972 | B2 * | 12/2019 | Horng | G05F 3/267 |
| 2007/0052473 | A1 * | 3/2007 | McLeod | G05F 3/30 327/539 |
| 2011/0267133 | A1 * | 11/2011 | Kumar | G05F 3/30 327/512 |

OTHER PUBLICATIONS

Sanjay Kumar Wadhwa and Nidhi Chaudhry, "High Accuracy, Multi-output Bandgap Reference Circuit in 16nm FinFet", 2017 30th International Conference on VLSI Design and 2017 16th International Conference on Embedded Systems (VLSID), Jan. 7-11, 2017, IEEE, Hyderabad, India.

Han-Xiao Du, Xin-Quan Lai, Cong Liu, and Yuan Chi, "Low quiescent current linear regulator using combination structure of bandgap and error amplifier", Electronics Letters, May 8, 2014, pp. 771-773, vol. 50, Issue. 10.

(Continued)

*Primary Examiner* — Thomas J. Hiltunen

(57) ABSTRACT

A bandgap voltage regulator includes a proportional-to-absolute-temperature (PTAT) circuit, an amplifier, and a driver circuit. The PTAT circuit can include various transistors that output a corresponding control voltage. The amplifier generates another control voltage to compensate base-current variations associated with the transistors of the PTAT circuit. The control voltage is generated by the amplifier based on the control voltage outputted by the PTAT circuit, and one of a base-emitter voltage associated with a transistor of the PTAT circuit, a scaled down version of the control voltage outputted by the amplifier, and a scaled down version of the base-emitter voltage. The driver circuit outputs, based on a supply voltage and the control voltages outputted by the PTAT circuit, a reference voltage for driving a functional circuit.

18 Claims, 4 Drawing Sheets

(56) References Cited

OTHER PUBLICATIONS

Kin Keung Jeff Lau, "An accurate, low impedance, low dropout sub-V bandgap reference", International Symposium on Signals, Circuits and Systems ISSCS2013, Jul. 11-12, 2013, IEEE, Iasi, Romania.

Edward K.F. Lee, "A low voltage low output impedance CMOS bandgap voltage reference", 2013 IEEE International Symposium on Circuits and Systems (ISCAS), May 19-23, 2013, IEEE, Beijing, China.

U.S. Appl. No. 17/247,257, filed Dec. 4, 2020, entitled Utilization of Voltage-Controlled Currents in Electronic Systems. The Examiner is referred to the copending patent prosecution of the common Applicant (no attachment).

* cited by examiner

BANDGAP VOLTAGE REGULATOR

BACKGROUND

The present disclosure relates generally to electronic circuits, and, more particularly, to a bandgap voltage regulator.

System-on-chips (SoCs) include various functional circuits (e.g., analog-to-digital converters, power management units, processors, or the like) and various bandgap voltage regulators that output and provide reference voltages to the functional circuits to drive the functional circuits. When the functional circuits are driven, the functional circuits execute various functional operations associated therewith. The bandgap voltage regulators can output the reference voltages that are less than a threshold value. The threshold value corresponds to a bandgap voltage at 0 kelvin (e.g., 1.23 volts). Hence, the bandgap voltage regulators can be utilized for biasing functional circuits that require sub-bandgap voltages (i.e., voltages less than 1.23 volts).

Typically, a bandgap voltage regulator requires a significant supply voltage (e.g., a voltage greater than 1.2 volts) to output a desired reference voltage. Further, a lowest voltage level of the reference voltage outputted by the bandgap voltage regulator is limited by base-emitter voltages of transistors included therein. For example, the lowest voltage level of the reference voltage that can be outputted by the bandgap voltage regulator is limited to 0.95 volts. An SoC, however, may include various functional circuits that require reference voltages less than the lowest voltage level of the reference voltage outputted by the bandgap voltage regulator. The bandgap voltage regulator is incapable of driving such functional circuits (i.e., is incapable of facilitating execution of functional operations of such functional circuits). Therefore, there exists a need for a technical solution that solves the aforementioned problems of existing bandgap voltage regulators.

SUMMARY

In an embodiment of the present disclosure, a bandgap voltage regulator is disclosed. The bandgap voltage regulator can include a proportional-to-absolute-temperature (PTAT) circuit, a first amplifier, and a driver circuit. The PTAT circuit can include a plurality of transistors that can be configured to output first and second control voltages. The first amplifier can be coupled with the PTAT circuit, and configured to receive a third control voltage and one of the first and second control voltages, and generate a fourth control voltage to facilitate compensation of base-current variations associated with the plurality of transistors. The third control voltage can be one of a scaled down version of the fourth control voltage, a scaled down version of a base-emitter voltage associated with a first transistor of the plurality of transistors, and the base-emitter voltage associated with the first transistor. The driver circuit can be configured to receive a supply voltage, receive a fifth control voltage that is generated based on the first and second control voltages, and output a reference voltage.

In another embodiment of the present disclosure, a system-on-chip (SoC) is disclosed. The SoC can include a functional circuit and a bandgap voltage regulator coupled with the functional circuit. The bandgap voltage regulator can include a PTAT circuit, a first amplifier, and a driver circuit. The PTAT circuit can include a plurality of transistors that can be configured to output first and second control voltages. The first amplifier can be coupled with the PTAT circuit, and configured to receive a third control voltage and one of the first and second control voltages, and generate a fourth control voltage to facilitate compensation of base-current variations associated with the plurality of transistors. The third control voltage can be one of a scaled down version of the fourth control voltage, a scaled down version of a base-emitter voltage associated with a first transistor of the plurality of transistors, and the base-emitter voltage associated with the first transistor. The driver circuit can be configured to receive a supply voltage, receive a fifth control voltage that is generated based on the first and second control voltages, and output a reference voltage. The driver circuit can be coupled with the functional circuit, and configured to provide the reference voltage to the functional circuit to drive the functional circuit.

In some embodiments, the bandgap voltage regulator can further include a second amplifier that can be coupled with the first transistor, a second transistor of the plurality of transistors, and the driver circuit, and configured to receive the first and second control voltages from the first and second transistors, respectively, and generate and provide the fifth control voltage to the driver circuit.

In some embodiments, the first and second transistors each have first through third terminals. The first terminals of the first and second transistors can be configured to output the first and second control voltages, respectively, and the third terminal of the first transistor can be coupled with a ground terminal.

In some embodiments, the PTAT circuit can further include first through third resistors. The first and second resistors can be coupled with the driver circuit, and configured to receive the reference voltage. The first and second resistors can be further coupled with the first terminals of the first and second transistors, respectively. The third resistor can be coupled between the third terminal of the second transistor and the ground terminal.

In some embodiments, the reference voltage can be equal to one of a sum of the second control voltage and a voltage drop across the second resistor, and a sum of the first control voltage and a voltage drop across the first resistor.

In some embodiments, the bandgap voltage regulator can further include a fourth resistor that can be coupled between the second terminals of the first and second transistors. The fourth resistor can be further coupled with the first amplifier, and configured to receive the fourth control voltage. The base-current variations associated with the first and second transistors can be compensated based on the fourth control voltage and a voltage drop across the fourth resistor.

In some embodiments, the bandgap voltage regulator can further include a first voltage divider circuit that can be coupled between the second terminal of the first transistor and the ground terminal. The first voltage divider circuit can be configured to output the third control voltage such that the third control voltage is the scaled down version of the base-emitter voltage associated with the first transistor. The first voltage divider circuit can be further coupled with the first amplifier, and configured to provide the third control voltage to the first amplifier.

In some embodiments, the first voltage divider circuit can include a fifth resistor that can be coupled with the second terminal of the first transistor and the first amplifier, and configured to output and provide the third control voltage to the first amplifier. The first voltage divider circuit can further include a first set of resistors that can be coupled between the fifth resistor and the ground terminal.

In some embodiments, the bandgap voltage regulator can further include sixth and seventh resistors. The sixth resistor can be coupled between the second terminals of the first and second transistors. The sixth resistor can be further coupled with the first amplifier, and configured to receive the fourth control voltage. The base-current variations associated with the first and second transistors can be compensated based on the fourth control voltage and a voltage drop across the sixth resistor. The seventh resistor can be coupled between the second and third terminals of the second transistor. The seventh resistor can be further coupled with the first amplifier, and configured to receive the fourth control voltage. The base-current variations associated with the first and second transistors can be further compensated based on a voltage drop across the seventh resistor.

In some embodiments, the bandgap voltage regulator can further include eighth and ninth resistors. The eighth resistor can be coupled between the second terminal of the first transistor and the first amplifier, and configured to receive the fourth control voltage. The base-current variations associated with the first transistor can be compensated based on the fourth control voltage and a voltage drop across the eighth resistor. The ninth resistor can be coupled between the second terminal of the second transistor and the first amplifier, and configured to receive the fourth control voltage. The base-current variations associated with the second transistor can be compensated based on the fourth control voltage and a voltage drop across the ninth resistor.

In some embodiments, the bandgap voltage regulator can further include a second voltage divider circuit that can be coupled between the first amplifier and the ground terminal. The second voltage divider circuit can be configured to receive the fourth control voltage from the first amplifier, output the third control voltage such that the third control voltage is the scaled down version of the fourth control voltage, and provide the third control voltage to the first amplifier.

In some embodiments, the second voltage divider circuit can include a tenth resistor that can be coupled with the first amplifier, and configured to receive the fourth control voltage, and output and provide the third control voltage to the first amplifier. The second voltage divider circuit can further include a second set of resistors that can be coupled between the tenth resistor and the ground terminal.

In some embodiments, the driver circuit can be coupled with the functional circuit, and configured to provide the reference voltage to the functional circuit to drive the functional circuit.

Various embodiments of the present disclosure disclose a bandgap voltage regulator that can include a PTAT circuit, an amplifier, and a driver circuit. The PTAT circuit can include various transistors that output a corresponding control voltage. The amplifier can generate another control voltage to facilitate compensation of base-current variations associated with the transistors of the PTAT circuit. The amplifier generates the control voltage based on a control voltage outputted by one transistor of the PTAT circuit and one of a base-emitter voltage associated with a transistor of the PTAT circuit, a scaled down version of the control voltage outputted by the amplifier, and a scaled down version of the base-emitter voltage. The driver circuit can output a reference voltage based on a supply voltage and the control voltages outputted by the PTAT circuit, and provide the reference voltage to a functional circuit to drive the functional circuit.

A lowest voltage level of the reference voltage outputted by the bandgap voltage regulator of the present disclosure is limited by a collector-emitter saturation voltage associated with the transistors of the PTAT circuit. As a result, the lowest voltage level of the reference voltage outputted by the bandgap voltage regulator of the present disclosure is less than that outputted by a conventional bandgap voltage regulator where the lowest voltage level of the reference voltage is limited by base-emitter voltages of transistors included therein. Further, the compensation of the base-current variations associated with the transistors of the PTAT circuit results in the bandgap voltage regulator of the present disclosure utilizing a lower voltage level of a supply voltage as compared to that utilized by the conventional bandgap voltage regulator. Hence, the bandgap voltage regulator of the present disclosure can be implemented on system-on-chips that operate at low supply voltages (e.g., 1 volt), and include functional circuits that require low reference voltages (e.g., 0.4-1.23 volts).

BRIEF DESCRIPTION OF THE DRAWINGS

The following detailed description of the preferred embodiments of the present disclosure will be better understood when read in conjunction with the appended drawings. The present disclosure is illustrated by way of example, and not limited by the accompanying figures, in which like references indicate similar elements.

DETAILED DESCRIPTION

The detailed description of the appended drawings is intended as a description of the currently preferred embodiments of the present disclosure, and is not intended to represent the only form in which the present disclosure may be practiced. It is to be understood that the same or equivalent functions may be accomplished by different embodiments that are intended to be encompassed within the spirit and scope of the present disclosure.

Figure 1:
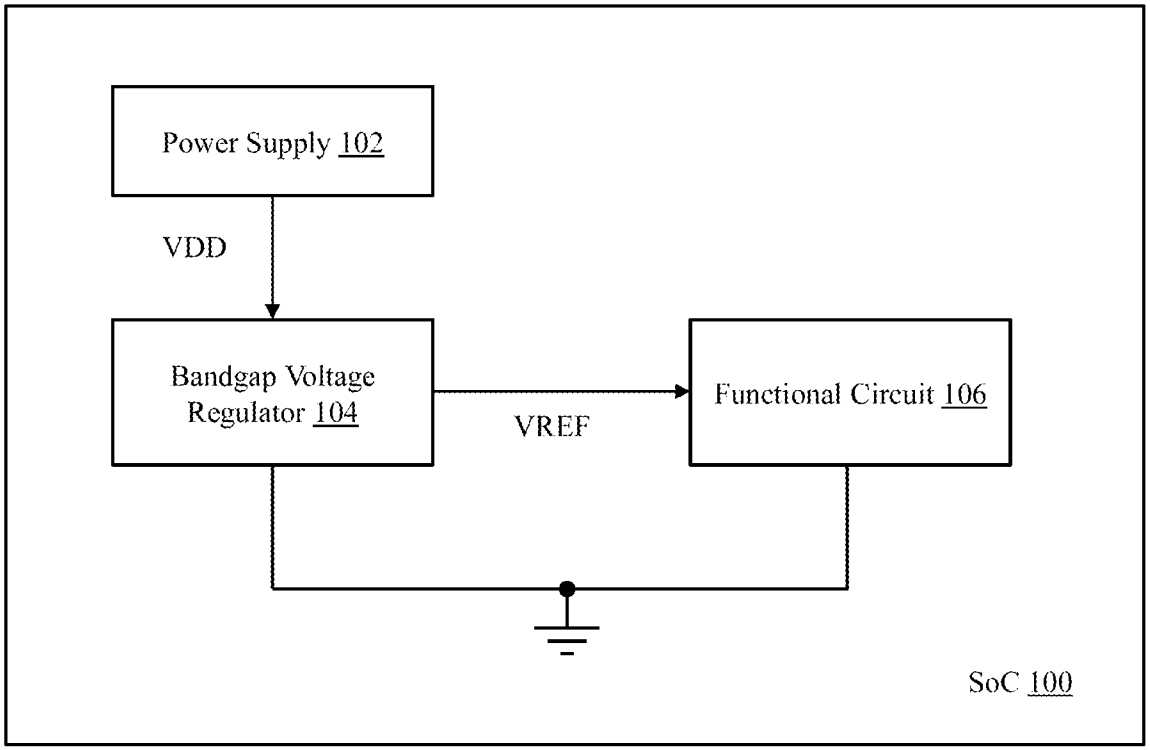
FIG. 1 illustrates a schematic block diagram of a system-on-chip (SoC) in accordance with an embodiment of the present disclosure.

FIG. 1 illustrates a schematic block diagram of a system-on-chip (SoC) 100 in accordance with an embodiment of the present disclosure. The SoC 100 can include a power supply 102 that can be configured to generate a supply voltage VDD. In an example, the supply voltage VDD is equal to 1 volt. Further, the SoC 100 can include a bandgap voltage regulator 104 and a functional circuit 106. The SoC 100 can be included in various devices such as automotive devices, networking devices, or the like.

The bandgap voltage regulator 104 can be coupled between the power supply 102 and a ground terminal, and further coupled with the functional circuit 106. The bandgap voltage regulator 104 can be configured to receive the supply voltage VDD from the power supply 102, and output a reference voltage VREF. Further, the bandgap voltage regulator 104 can be configured to provide the reference voltage VREF to the functional circuit 106 to drive the functional circuit 106. In an embodiment, the reference voltage VREF is less than a threshold value (not shown). The threshold value corresponds to a bandgap voltage at 0 kelvin (K) (e.g., 1.23V). The bandgap voltage regulator 104 is explained in detail in conjunction with FIGS. 2A-2C.

The functional circuit 106 can be coupled between the bandgap voltage regulator 104 and the ground terminal. The functional circuit 106 can be driven by the bandgap voltage regulator 104 by way of the reference voltage VREF. In such a scenario, the functional circuit 106 can be configured to execute various operations associated therewith. Examples of the functional circuit 106 can include analog-to-digital converters, power management units, processors, or the like.

Although FIG. 1 illustrates that the SoC 100 includes a single functional circuit (i.e., the functional circuit 106), it will be apparent to a person skilled in the art that the scope of the present disclosure is not limited to it. In various other embodiments, the SoC 100 may include more than one functional circuit, without deviating from the scope of the present disclosure. In such a scenario, the bandgap voltage regulator 104 can be further configured to provide the reference voltage VREF to each functional circuit to drive the corresponding functional circuit.

Figure 2A:
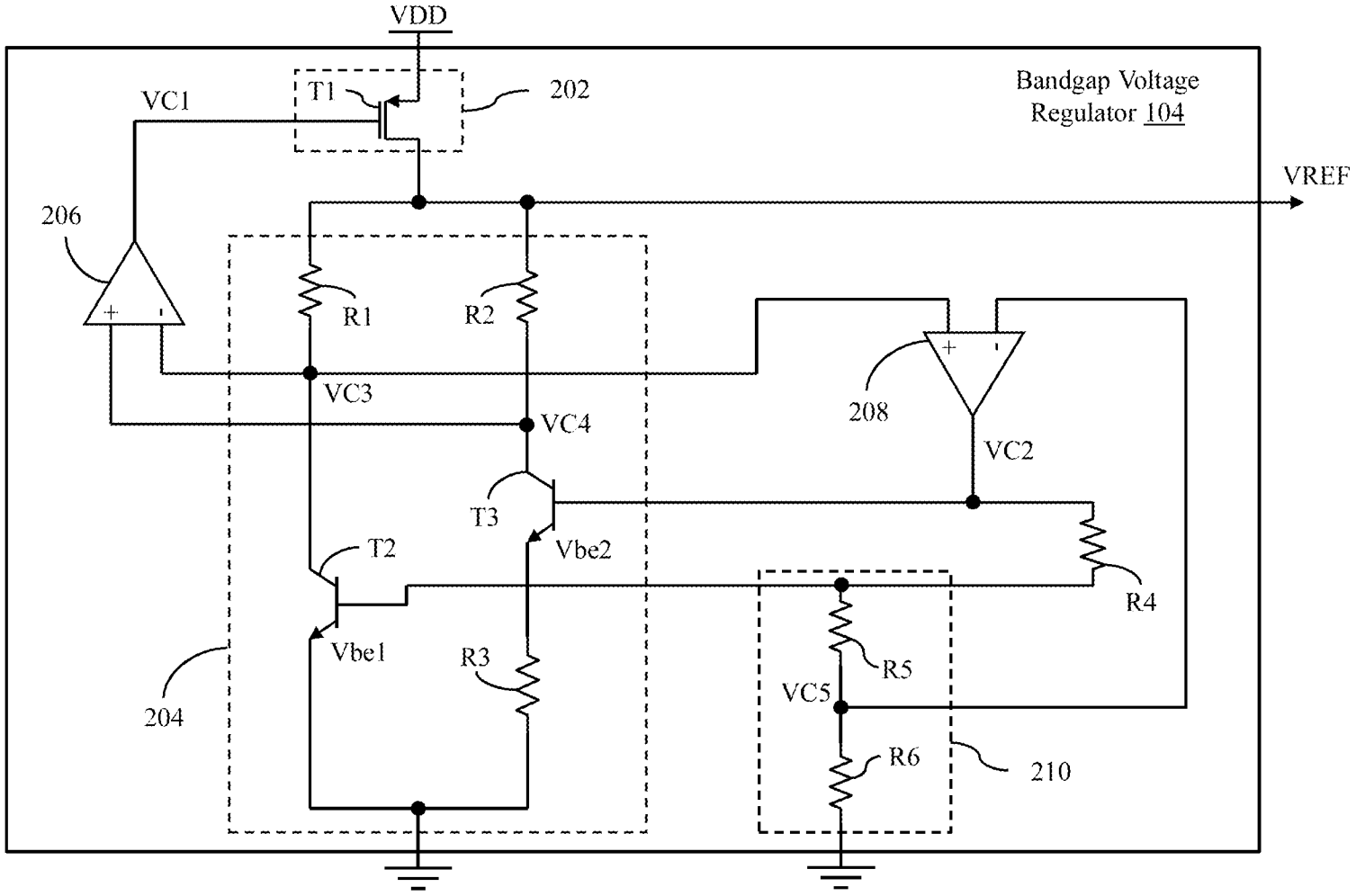
FIG. 2A illustrates a schematic circuit diagram of a bandgap voltage regulator of the SoC of FIG. 1 in accordance with an embodiment of the present disclosure.

FIG. 2A illustrates a schematic circuit diagram of the bandgap voltage regulator 104 in accordance with an embodiment of the present disclosure. The bandgap voltage regulator 104 can include a driver circuit 202, a proportional-to-absolute-temperature (PTAT) circuit 204, first and second amplifiers 206 and 208, and a first voltage divider circuit 210.

The driver circuit 202 can be coupled with the power supply 102, the first amplifier 206, and the functional circuit 106. The driver circuit 202 can be configured to receive the supply voltage VDD and a first control voltage VC1 from the power supply 102 and the first amplifier 206, respectively. Based on the supply voltage VDD and the first control voltage VC1, the driver circuit 202 can be further configured to output the reference voltage VREF. Further, the driver circuit 202 can be configured to provide the reference voltage VREF to the functional circuit 106 to drive the functional circuit 106. In the presently preferred embodiment, the driver circuit 202 is a first transistor T1. The first transistor T1 can be a p-channel metal-oxide semiconductor (PMOS) transistor that has source, gate, and drain terminals coupled with the power supply 102, the first amplifier 206, and the functional circuit 106, respectively. The source and gate terminals of the first transistor T1 can be configured to receive the supply voltage VDD and the first control voltage VC1 from the power supply 102 and the first amplifier 206, respectively. Further, the drain terminal of the first transistor T1 can be configured to output and provide the reference voltage VREF to the functional circuit 106 to drive the functional circuit 106. It will however be apparent to a person skilled in the art that the scope of the present disclosure is not limited to the first transistor T1 (i.e., a PMOS transistor) being utilized as the driver circuit 202. In various other embodiments, the driver circuit 202 may be implemented in a different manner, without deviating from the scope of the present disclosure.

The PTAT circuit 204 can be coupled between the driver circuit 202 and the ground terminal, and further coupled with the first and second amplifiers 206 and 208. The PTAT circuit 204 can be configured to receive the reference voltage VREF from the driver circuit 202, and a second control voltage VC2 from the second amplifier 208. Based on the reference voltage VREF and the second control voltage VC2, the PTAT circuit 204 can be further configured to output third and fourth control voltages VC3 and VC4. Further, the PTAT circuit 204 can be configured to provide the third and fourth control voltages VC3 and VC4 to the first amplifier 206. The PTAT circuit 204 can include second and third transistors T2 and T3 each having first through third terminals, and first through third resistors R1-R3 each having first and second terminals.

The first terminals of the first and second resistors R1 and R2 can be coupled with the driver circuit 202. The first terminals of the first and second resistors R1 and R2 can be configured to receive the reference voltage VREF from the driver circuit 202. The first terminals of the second and third transistors T2 and T3 can be coupled with the second terminals of the first and second resistors R1 and R2, respectively. Further, the first terminals of the second and third transistors T2 and T3 can be coupled with the first amplifier 206. The first terminals of the second and third transistors T2 and T3 can be configured to output and provide the third and fourth control voltages VC3 and VC4 to the first amplifier 206, respectively. The second and third terminals of the second transistor T2 can be coupled with the first voltage divider circuit 210 and the ground terminal, respectively. The second terminal of the third transistor T3 can be coupled with the second amplifier 208. The second terminal of the third transistor T3 can be configured to receive the second control voltage VC2 from the second amplifier 208. The third terminal of the third transistor T3 can be coupled with the first terminal of the third resistor R3. Further, the second terminal of the third resistor R3 can be coupled with the ground terminal. In other words, the third resistor R3 can be coupled between the third terminal of the third transistor T3 and the ground terminal. The third and fourth control voltages VC3 and VC4 can thus be outputted based on the reference voltage VREF and the second control voltage VC2. Further, as illustrated in FIG. 2A, the reference voltage VREF can be equal to a sum of the third control voltage VC3 and a voltage drop across the first resistor R1.

The second and third transistors T2 and T3, in combination with the first through third resistors R1-R3, can thus output and provide the third and fourth control voltages VC3 and VC4 to the first amplifier 206, respectively. In an embodiment, the second and third transistors T2 and T3 are NPN bipolar junction transistors, and the first through third terminals of the second and third transistors T2 and T3 correspond to collector, base, and emitter terminals, respectively. Further, a size of the third transistor T3 can be greater than a size of the second transistor T2. In an example, the size of the third transistor T3 is '8' times the size of the second transistor T2. As the second and third terminals of the second and third transistors T2 and T3 correspond to base and emitter terminals, it will be apparent to a person skilled in the art that base-emitter voltages can be generated at junctions between the second and third terminals of the second and third transistors T2 and T3. For example, a first base-emitter voltage Vbe1 can be generated at a junction between the second and third terminals of the second transistor T2. Similarly, a second base-emitter voltage Vbe2 can be generated at a junction between the second and third terminals of the third transistor T3.

The first amplifier 206 can be coupled with the driver circuit 202 and the PTAT circuit 204 (i.e., the first terminals of the second and third transistors T2 and T3). The first amplifier 206 can include suitable circuitry that can be configured to perform one or more operations. For example, the first amplifier 206 can be configured to receive the third and fourth control voltages VC3 and VC4 from the PTAT circuit 204 (i.e., the first terminals of the second and third transistors T2 and T3, respectively). In an embodiment, the first amplifier 206 receives the third and fourth control voltages VC3 and VC4 at negative and positive input terminals thereof, respectively. Based on the third and fourth control voltages VC3 and VC4, the first amplifier 206 can be further configured to generate the first control voltage VC1. The first control voltage VC1 can be greater than a difference between the third and fourth control voltages VC3 and VC4. The first amplifier 206 can be further configured to provide the first control voltage VC1 to the driver circuit 202 to control an operation of the driver circuit 202. The reference voltage VREF can be thus outputted based on the third and fourth control voltages VC3 and VC4 and the supply voltage VDD.

The first amplifier 206 can be further configured to execute frequency compensation operations associated with the bandgap voltage regulator 104 to maintain stability of the bandgap voltage regulator 104. It will however be apparent to a person skilled in the art that the scope of the present disclosure is not limited to the first amplifier 206 executing the frequency compensation operations associated with the bandgap voltage regulator 104. In various other embodiments, the bandgap voltage regulator 104 can include various decoupling capacitors and resistors (not shown) for executing the frequency compensation operations associated therewith, without deviating from the scope of the present disclosure. In such a scenario, a series of one decoupling capacitor and one resistor can be coupled between the driver circuit 202 and the first amplifier 206, and another decoupling capacitor can be coupled in parallel with the first resistor R1 of the PTAT circuit 204.

The second amplifier 208 can be coupled with the PTAT circuit 204 (i.e., the first terminal of the second transistor T2 and the second terminal of the third transistor T3) and the first voltage divider circuit 210. The second amplifier 208 can include suitable circuitry that can be configured to perform one or more operations. For example, the second amplifier 208 can be configured to receive the third control voltage VC3 from the first terminal of the second transistor T2 and a fifth control voltage VC5 from the first voltage divider circuit 210. In an embodiment, the second amplifier 208 receives the third and fifth control voltages VC3 and VC5 at positive and negative input terminals thereof, respectively. The second amplifier 208 can be further configured to generate the second control voltage VC2 based on the third and fifth control voltages VC3 and VC5, and provide the second control voltage VC2 to the second terminal of the third transistor T3. The second control voltage VC2 can be generated to facilitate compensation of base-current variations associated with the second and third transistors T2 and T3. The second control voltage VC2 can be greater than a difference between the third and fifth control voltages VC3 and VC5.

The bandgap voltage regulator 104 can further include a fourth resistor R4 that has first and second terminals coupled with the second terminals of the third and second transistors T3 and T2, respectively. In other words, the fourth resistor R4 can be coupled between the second terminals of the third and second transistors T3 and T2. The first terminal of the fourth resistor R4 can be further coupled with the second amplifier 208. The first terminal of the fourth resistor R4 can be configured to receive the second control voltage VC2 from the second amplifier 208. Further, the second terminal of the fourth resistor R4 can be coupled with the first voltage divider circuit 210. Thus, based on the second control voltage VC2 and a voltage drop across the fourth resistor R4, the base-current variations associated with the second and third transistors T2 and T3 can be compensated.

The first voltage divider circuit 210 can be coupled between the PTAT circuit 204 (i.e., the second terminal of the second transistor T2) and the ground terminal, and further coupled with the second terminal of the fourth resistor R4 and the second amplifier 208. The first voltage divider circuit 210 can thus be configured to receive, from the second terminal of the second transistor T2, the first base-emitter voltage Vbe1 associated with the second transistor T2. Further, the first voltage divider circuit 210 can be configured to output the fifth control voltage VC5 such that the fifth control voltage VC5 is a scaled down version of the first base-emitter voltage Vbe1. The first voltage divider circuit 210 can be further configured to provide the fifth control voltage VC5 to the second amplifier 208. The first voltage divider circuit 210 can include fifth and sixth resistors R5 and R6.

The fifth resistor R5 has a first terminal that can be coupled with the PTAT circuit 204 (i.e., the second terminal of the second transistor T2) and a second terminal that can be coupled with the second amplifier 208. The first terminal of the fifth resistor R5 can be configured to receive the first base-emitter voltage Vbe1 from the PTAT circuit 204 (i.e., the second terminal of the second transistor T2). The first terminal of the fifth resistor R5 can be further coupled with the second terminal of the fourth resistor R4. The second terminal of the fifth resistor R5 can be configured to output and provide the fifth control voltage VC5 to the second amplifier 208. The sixth resistor R6 has a first terminal that can be coupled with the second terminal of the fifth resistor R5, and a second terminal that can be coupled with the ground terminal. In other words, the sixth resistor R6 can be coupled between the fifth resistor R5 and the ground terminal.

Although it is shown that a single resistor (i.e., the sixth resistor R6) is coupled between the fifth resistor R5 and the ground terminal, it will be apparent to a person skilled in the art that the scope of the present disclosure is not limited to it. In various other embodiments, a series of two or more resistors can be coupled between the fifth resistor R5 and the ground terminal, without deviating from the scope of the present disclosure. In such a scenario, a total resistance value of the series of two or more resistors is equal to the resistance value of the sixth resistor R6. Further, the fifth control voltage VC5 can be outputted at any intermediate terminal of the series of two or more resistors.

As illustrated in FIG. 2A, the reference voltage VREF is equal to the sum of the third control voltage VC3 and the voltage drop across the first resistor R1. The reference voltage VREF can be determined as shown below in equation (1):

$$VREF = VC3 + V_{R1} \tag{1}$$

where, $V_{R1}$ is the voltage drop across the first resistor R1.

The second transistor T2, the fourth resistor R4, the third transistor T3, and the third resistor R3 form a closed loop. In such a scenario, Kirchhoff's voltage law (KVL) can be applied as shown below in equation (2):

$$Vbe1 + R4 * \left(\frac{Vbe1}{R5 + R6} + I_{b1}\right) - Vbe2 - (R3 * I_{R3}) = 0 \tag{2}$$

where, $I_{b1}$ is the base current associated with the second transistor T2, and $I_{R3}$ is the current passing through the third resistor R3.

For the sake on ongoing discussion, it is assumed that the resistance values of the third and fourth resistors R3 and R4 are equal, and the resistance values of the first and second resistors R1 and R2 are equal. Further, on rearranging equation (2), equation (3) can be obtained as shown below:

$$I_{R3} = \frac{\Delta Vbe}{R4} + \frac{Vbe1}{R5 + R6} + I_{b1} \tag{3}$$

where,

ΔVbe is the difference between the first and second base-emitter voltages Vbe1 and Vbe2.

As illustrated in FIG. 2A, the current passing through the second resistor R2 can be equal to the difference between the current passing through the third resistor R3 and a base current associated with the third transistor T3. Further, in the bandgap voltage regulator 104 of the present disclosure, it is assumed that β variations associated with the second and third transistors T2 and T3 are negligible. In other words, a ratio of collector and base currents associated with the second transistor T2 is equal to a ratio of collector and base currents associated with the third transistor T3. Further, as the resistance values of the first and second resistors R1 and R2 are equal, the collector currents associated with the second and third transistors T2 and T3 are equal. Hence, the base current associated with the second transistor T2 is equal to the base current associated with the third transistor T3. Thus, the current passing through the second resistor R2 can be determined as shown below in equation (4):

$$I_{R2} = I_{R3} - I_{b1} \tag{4}$$

where, $I_{R2}$ is the current passing through the second resistor R2.

Substituting equation (3) in equation (4), equation (5) can be obtained as shown below:

$$I_{R2} = \frac{\Delta Vbe}{R4} + \frac{Vbe1}{R5 + R6} \tag{5}$$

Further, as illustrated in FIG. 2A, the first amplifier 206 is coupled in a negative feedback configuration (i.e., the first amplifier 206, the driver circuit 202, the first and second resistors R1 and R2, and the second and third transistors T2 and T3 form a negative feedback loop). Hence, the first amplifier 206 drives the third and fourth control voltages VC3 and VC4 to be equal. Thus, a voltage drop across the second resistor R2 (i.e., a product of the resistance value of the second resistor R2 and the current passing through the second resistor R2) is equal to the voltage drop across the first resistor R1 (i.e., a product of the resistance value of the first resistor R1 and the current passing through the first resistor R1) as shown below in equation (6):

$$I_{R2} * R2 = I_{R1} * R1 \tag{6}$$

where, $I_{R1}$ is the current passing through the first resistor R1.

Thus, based on equations (5) and (6), the voltage drop across the first resistor R1 can be determined as shown below in equation (7):

$$V_{R1} = \frac{R2 * \Delta Vbe}{R4} + \frac{R2 * Vbe1}{R5 + R6} \tag{7}$$

As illustrated in FIG. 2A, the second amplifier 208 is coupled in a negative feedback configuration (i.e., the second amplifier 208, the fourth resistor R4, the first voltage divider circuit 210, and the second and third transistors T2 and T3 form a negative feedback loop). Hence, the second amplifier 208 drives the third and fifth control voltages VC3 and VC5 to be equal. Thus, the third control voltage VC3 can be determined as shown below in equation (8):

$$VC3 = \frac{R6 * Vbe1}{R5 + R6} \tag{8}$$

Thus, substituting equations (7) and (8) in equation (1), equation (9) can be obtained as shown below:

$$VREF = \frac{R6 * Vbe1}{R5 + R6} + \frac{R2 * \Delta Vbe}{R4} + \frac{R2 * Vbe1}{R5 + R6} \tag{9}$$

Further, on rearranging equation (9), equation (10) can be obtained as shown below:

$$VREF = \frac{(R6 + R2) * Vbe1}{R5 + R6} + \frac{R2 * \Delta Vbe}{R4} \tag{10}$$

The difference between the first and second base-emitter voltages Vbe1 and Vbe2 (i.e., ΔVbe) has a positive temperature co-efficient, whereas the first base-emitter voltage Vbe1 has a negative temperature co-efficient. Thus, based on resistance values of the second, fourth, fifth, and sixth resistors R2, R4, R5, and R6, a temperature-independent reference voltage VREF may be outputted.

The first base-emitter voltage Vbe1 has a negative temperature co-efficient. Thus, at high temperatures (e.g., 425 K), the first base-emitter voltage Vbe1 can be at a lower voltage level as compared to low temperatures (e.g., 233 K). Hence, the third control voltage VC3 (i.e., the scaled down version of the first base-emitter voltage Vbe1) can be at a lower voltage level at high temperatures as compared to low temperatures. The third control voltage VC3 corresponds to a collector voltage associated with the second transistor T2. Therefore, to ensure that the second transistor T2 is operating in an active mode, the third control voltage VC3 is required to be greater than a collector-emitter saturation voltage associated with the second transistor T2. Thus, the relation between the first base-emitter voltage Vbe1 and the collector-emitter saturation voltage associated with the second transistor T2 can be determined as shown below in equation (11):

$$\frac{R6 * Vbe1_{(TH)}}{R5 + R6} > Vce1_{(sat)(TH)} \tag{11}$$

where, $Vbe1_{(TH)}$ and $Vce1_{(sat)(TH)}$ are the first base-emitter voltage Vbe1 and the collector-emitter saturation voltage associated with the second transistor T2 at a highest temperature (e.g., 425 K), respectively.

In such a scenario, the relation between the reference voltage VREF, the first base-emitter voltage Vbe1, and the collector-emitter saturation voltage associated with the second transistor T2 can be determined as shown below in equation (12):

$$VREF > \left(\frac{Vce1_{(sat)(TH)}}{Vbe1_{(TH)}} * V_{bg0}\right) \quad (12)$$

where, $V_{bg0}$ is the bandgap voltage at 0 K.

The lowest voltage level of the reference voltage VREF can thus be determined based on a ratio of the collector-emitter saturation voltage and the first base-emitter voltage Vbe1 at a highest temperature (e.g., 425 K). It will be apparent to a person skilled in the art that the ratio of the collector-emitter saturation voltage and the first base-emitter voltage Vbe1 is less than one. In an embodiment, the lowest voltage level of the reference voltage VREF can be equal to 0.4 volts. In such a scenario, the reference voltage VREF can be in a range of 0.4 volts to 1.23 volts.

Figure 2B:
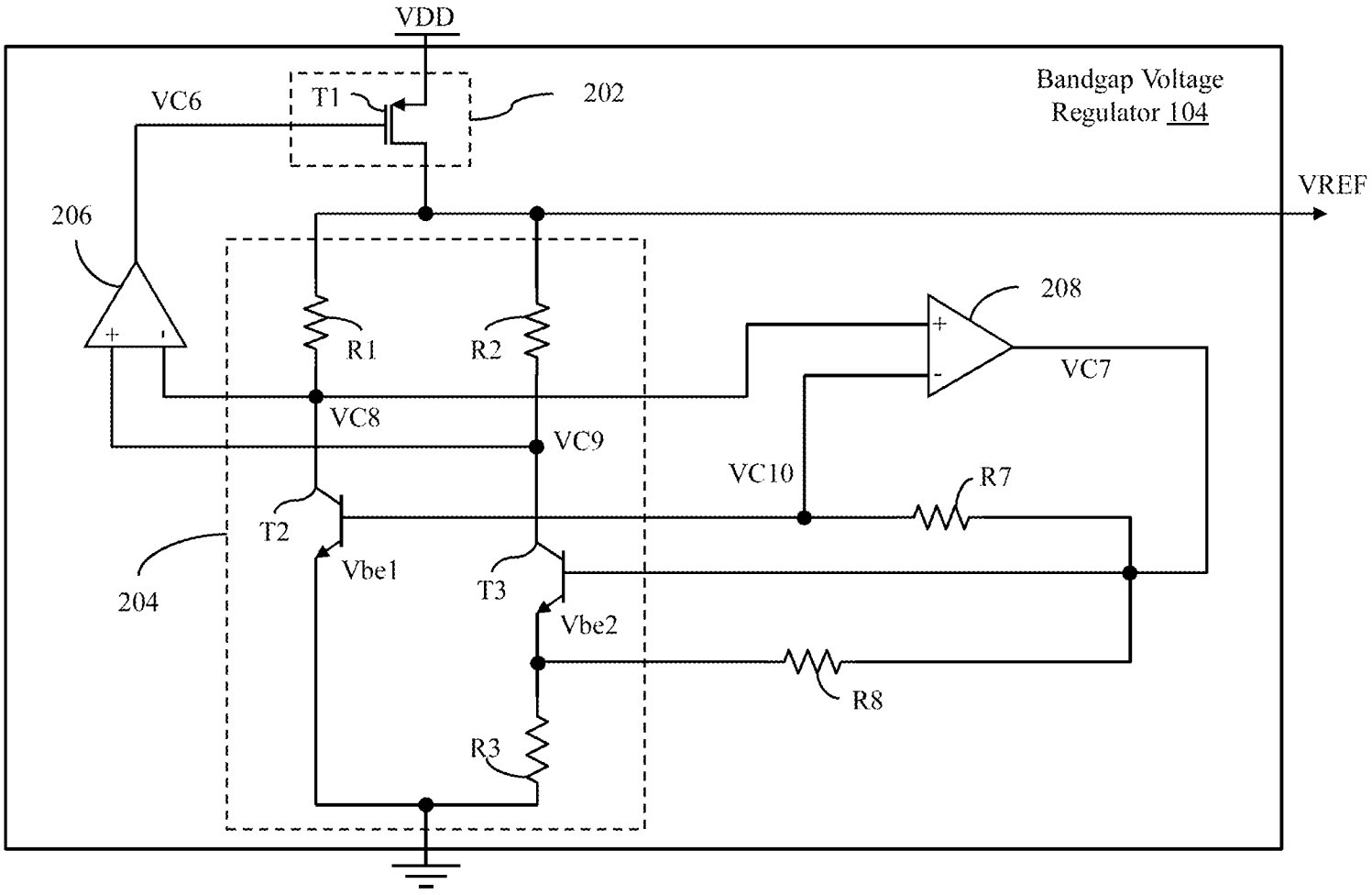
FIG. 2B illustrates a schematic circuit diagram of the bandgap voltage regulator in accordance with another embodiment of the present disclosure.

FIG. 2B illustrates a schematic circuit diagram of the bandgap voltage regulator 104 in accordance with another embodiment of the present disclosure. The bandgap voltage regulator 104 can include the driver circuit 202, the PTAT circuit 204, and the first and second amplifiers 206 and 208.

The driver circuit 202 can be coupled with the power supply 102, the first amplifier 206, and the functional circuit 106. The driver circuit 202 can be configured to receive the supply voltage VDD from the power supply 102, and a sixth control voltage VC6 from the first amplifier 206. Based on the supply voltage VDD and the sixth control voltage VC6, the driver circuit 202 can be further configured to output the reference voltage VREF. Further, the driver circuit 202 can be configured to provide the reference voltage VREF to the functional circuit 106 to drive the functional circuit 106.

The PTAT circuit 204 can be coupled between the driver circuit 202 and the ground terminal, and further coupled with the first and second amplifiers 206 and 208. The PTAT circuit 204 can be configured to receive the reference voltage VREF from the driver circuit 202, and a seventh control voltage VC7 from the second amplifier 208. Based on the reference voltage VREF and the seventh control voltage VC7, the PTAT circuit 204 can be further configured to output eighth and ninth control voltages VC8 and VC9. Further, the PTAT circuit 204 can be configured to provide the eighth and ninth control voltages VC8 and VC9 to the first amplifier 206. The PTAT circuit 204 can include the second and third transistors T2 and T3, and the first through third resistors R1-R3.

The first terminals of the first and second resistors R1 and R2 can be coupled with the driver circuit 202. The first terminals of the first and second resistors R1 and R2 can be configured to receive the reference voltage VREF from the driver circuit 202. The first terminals of the second and third transistors T2 and T3 can be coupled with the second terminals of the first and second resistors R1 and R2, respectively. The first terminals of the second and third transistors T2 and T3 can be further coupled with the first amplifier 206. Further, the first terminals of the second and third transistors T2 and T3 can be configured to output and provide the eighth and ninth control voltages VC8 and VC9 to the first amplifier 206, respectively. The second and third terminals of the second transistor T2 can be coupled with the second amplifier 208 and the ground terminal, respectively. The second terminal of the third transistor T3 can be coupled with the second amplifier 208. The second terminal of the third transistor T3 can be configured to receive the seventh control voltage VC7 from with the second amplifier 208. The third terminal of the third transistor T3 can be coupled with the first terminal of the third resistor R3. Further, the second terminal of the third resistor R3 can be coupled with the ground terminal. The eighth and ninth control voltages VC8 and VC9 can thus be outputted based on the reference voltage VREF and the seventh control voltage VC7. As illustrated in FIG. 2B, the reference voltage VREF can thus be equal to a sum of the eighth control voltage VC8 and the voltage drop across the first resistor R1.

The first amplifier 206 can be coupled with the first terminals of the second and third transistors T2 and T3 and the driver circuit 202. The first amplifier 206 can be configured to receive the eighth and ninth control voltages VC8 and VC9 from the first terminals of the second and third transistors T2 and T3, respectively. In an embodiment, the first amplifier 206 receives the eighth and ninth control voltages VC8 and VC9 at the negative and positive input terminals thereof, respectively. Based on the eighth and ninth control voltages VC8 and VC9, the first amplifier 206 can be further configured to generate the sixth control voltage VC6. The sixth control voltage VC6 can be greater than a difference between the eighth and ninth control voltages VC8 and VC9. Further, the first amplifier 206 can be configured to provide the sixth control voltage VC6 to the driver circuit 202 to control the operation of the driver circuit 202. The reference voltage VREF can be thus outputted based on the eighth and ninth control voltages VC8 and VC9 and the supply voltage VDD.

The second amplifier 208 can be coupled with the first and second terminals of the second transistor T2 and the second terminal of the third transistor T3. The second amplifier 208 can be configured to receive the eighth control voltage VC8 and a tenth control voltage VC10 from the first and second terminals of the second transistor T2, respectively. In an embodiment, the second amplifier 208 receives the eighth and tenth control voltages VC8 and VC10 at the positive and negative input terminals thereof, respectively. Further, as illustrated in FIG. 2B, the tenth control voltage VC10 can correspond to the first base-emitter voltage Vbe1. The second amplifier 208 can be further configured to generate the seventh control voltage VC7 based on the eighth and tenth control voltages VC8 and VC10, and provide the seventh control voltage VC7 to the second terminal of the third transistor T3. The seventh control voltage VC7 can be generated to facilitate the compensation of the base-current variations associated with the second and third transistors T2 and T3. Further, the seventh control voltage VC7 can be greater than a difference between the eighth and tenth control voltages VC8 and VC10.

The bandgap voltage regulator 104 can further include a seventh resistor R7 that has first and second terminals coupled with the second terminals of the second and third transistors T2 and T3, respectively. In other words, the seventh resistor R7 can be coupled between the second terminals of the second and third transistors T2 and T3. The second terminal of the seventh resistor R7 can be further coupled with the second amplifier 208. The second terminal of the seventh resistor R7 can be further configured to receive the seventh control voltage VC7 from the second amplifier 208. Thus, based on the seventh control voltage VC7 and a voltage drop across the seventh resistor R7, the base-current variations associated with the second and third transistors T2 and T3 can be compensated.

The bandgap voltage regulator 104 can further include an eighth resistor R8 that has first and second terminals coupled with the second and third terminals of the third transistor T3, respectively. In other words, the eighth resistor R8 can be coupled between the second and third terminals of the third transistor T3. The first terminal of the eighth resistor R8 can be further coupled with the second amplifier 208. The first terminal of the eighth resistor R8 can be further configured to receive the seventh control voltage VC7 from the second amplifier 208. Thus, the base-current variations associated with the second and third transistors T2 and T3 can be further compensated based on a voltage drop across the eighth resistor R8.

As illustrated in FIG. 2B, the reference voltage VREF is equal to the sum of the eighth control voltage VC8 and the voltage drop across the first resistor R1. The reference voltage VREF can be determined as shown below in equation (13):

$$VREF=VC8+V_{R1} \tag{13}$$

The second transistor T2, the seventh resistor R7, the third transistor T3, and the third resistor R3 form a closed loop. In such a scenario, KVL can be applied as shown below in equation (14):

$$Vbe1+R7*I_{b1}-Vbe2-(R3*I_{R3})=0 \tag{14}$$

For the sake on ongoing discussion, it is assumed that the resistance values of the seventh and third resistors R7 and R3 are equal and that the resistance values of the first and second resistors R1 and R2 are equal. Further, on rearranging equation (14), equation (15) can be obtained as shown below:

$$I_{R3}=\frac{\Delta Vbe}{R7}+I_{b1} \tag{15}$$

As illustrated in FIG. 2B, the current passing through the second resistor R2 can be equal to the difference between the current passing through the third resistor R3 and the base current associated with the third transistor T3. In the band-gap voltage regulator 104 of the present disclosure, it is assumed that β variations associated with the second and third transistors T2 and T3 are negligible. In other words, the ratio of collector and base currents associated with the second transistor T2 is equal to the ratio of collector and base currents associated with the third transistor T3. Further, as the resistance values of the first and second resistors R1 and R2 are equal, the collector currents associated with the second and third transistors T2 and T3 are equal. Hence, the base current associated with the second transistor T2 is equal to the base current associated with the third transistor T3. Thus, the current passing through the second resistor R2 can be determined as shown below in equation (16):

$$I_{R2}=I_{R3}-\frac{Vbe2}{R8}-I_{b1} \tag{16}$$

where, $$\frac{Vbe2}{R8}$$

is the current passing through the eighth resistor R8.

Substituting equation (15) in equation (16), equation (17) can be obtained as shown below:

$$I_{R2}=\frac{\Delta Vbe}{R7}-\frac{Vbe2}{R8} \tag{17}$$

Further, the first amplifier 206 is coupled in a negative feedback configuration (i.e., the first amplifier 206, the driver circuit 202, the first and second resistors R1 and R2, and the second and third transistors T2 and T3 form a negative feedback loop). Hence, the first amplifier 206 drives the eighth and ninth control voltages VC8 and VC9 to be equal. Thus, the voltage drop across the second resistor R2 (i.e., the product of the resistance value of the second resistor R2 and the current passing through the second resistor R2) is equal to the voltage drop across the first resistor R1 (i.e., the product of the resistance value of the first resistor R1 and the current passing through the first resistor R1) as shown below in equation (18):

$$I_{R2}*R2=I_{R1}*R1 \tag{18}$$

Thus, based on equations (17) and (18), the voltage drop across the first resistor R1 can be determined as shown below in equation (19):

$$V_{R1}=\frac{R2*\Delta Vbe}{R7}-\frac{R2*Vbe2}{R8} \tag{19}$$

Further, on replacing 'Vbe2' with 'Vbe1−ΔVbe' and rearranging equation (19), equation (20) can be obtained as shown below:

$$V_{R1}=\Delta Vbe*\left(\frac{R2}{R7}+\frac{R2}{R8}\right)-\frac{R2*Vbe1}{R8} \tag{20}$$

As illustrated in FIG. 2B, the second amplifier 208 is coupled in a negative feedback configuration (i.e., the second amplifier 208, the seventh and eighth resistors R7 and R8, and the second and third transistors T2 and T3 form a negative feedback loop). Hence, the second amplifier 208 drives the eighth and tenth control voltages VC8 and VC10 to be equal. Thus, the eighth control voltage VC8 can be determined as shown below in equation (21):

$$VC8=Vbe1 \tag{21}$$

Further, substituting equations (20) and (21) in equation (13), equation (22) can be obtained as shown below:

$$VREF=\Delta\text{Vbe}*\left(\frac{R2}{R7}+\frac{R2}{R8}\right)-\frac{R2*Vbe1}{R8}+Vbe1 \tag{22}$$

Further, on rearranging equation (22), equation (23) can be obtained as shown below:

$$VREF=\Delta\text{V}be*\left(\frac{R2}{R7}+\frac{R2}{R8}\right)+Vbe1*\left(1-\frac{R2}{R8}\right) \tag{23}$$

The difference between the first and second base-emitter voltages Vbe1 and Vbe2 (i.e., ΔVbe) has a positive temperature co-efficient, whereas the first base-emitter voltage Vbe1 has a negative temperature co-efficient. Thus, based on resistance values of the second, seventh, and eighth resistors R2, R7, and R8, a temperature-independent reference voltage VREF may be outputted.

The first base-emitter voltage Vbe1 has a negative temperature co-efficient. Thus, at low temperatures (e.g., 233 K), the first base-emitter voltage Vbe1 can be at a higher voltage level as compared to high temperatures (e.g., 425 K). Hence, the eighth control voltage VC8 (i.e., the first base-emitter voltage Vbe1) can be at a higher voltage level at low temperatures as compared to high temperatures. The reference voltage VREF is greater than the eighth control voltage VC8. Consequently, the reference voltage VREF is greater than the first base-emitter voltage Vbe1. A lowest voltage level of the reference voltage VREF is thus greater than the first base-emitter voltage Vbe1 at a lowest temperature (e.g., 233 K) as shown below in equation (24):

$$VREF > Vbe1_{(TL)} \quad (24)$$

where, $Vbe1_{(TL)}$ is the first base-emitter voltage Vbe1 at a lowest temperature (e.g., 233 K).

In an embodiment, the lowest voltage level of the reference voltage VREF can be equal to 0.85 volts. In such a scenario, the reference voltage VREF can be in a range of 0.85 volts to 1.23 volts.

Figure 2C:
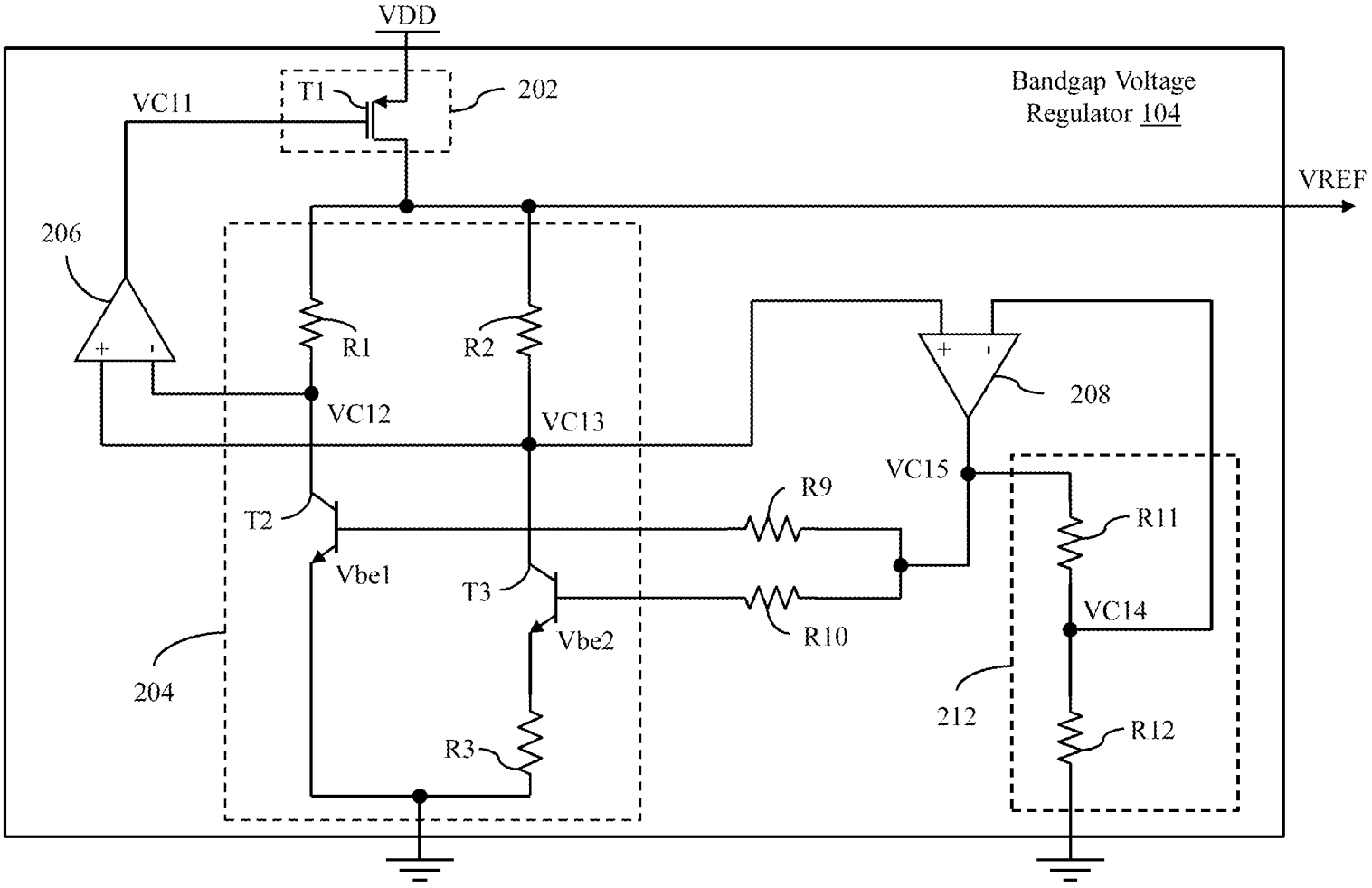
FIG. 2C illustrates a schematic circuit diagram of the bandgap voltage regulator in accordance with yet another embodiment of the present disclosure.

FIG. 2C illustrates a schematic circuit diagram of the bandgap voltage regulator 104 in accordance with yet another embodiment of the present disclosure. The bandgap voltage regulator 104 can include the driver circuit 202, the PTAT circuit 204, the first and second amplifiers 206 and 208, a second voltage divider circuit 212, and ninth and tenth resistors R9 and R10 each having first and second terminals.

The driver circuit 202 can be coupled with the power supply 102, the first amplifier 206, and the driver circuit 202. The driver circuit 202 can be configured to receive the supply voltage VDD from the power supply 102, and an eleventh control voltage VC11 from the first amplifier 206. Based on the supply voltage VDD and the eleventh control voltage VC11, the driver circuit 202 can be further configured to output the reference voltage VREF. Further, the driver circuit 202 can be configured to provide the reference voltage VREF to the functional circuit 106 to drive the functional circuit 106.

The PTAT circuit 204 can be coupled between the driver circuit 202 and the ground terminal, and further coupled with the first amplifier 206. The PTAT circuit 204 can be configured to receive the reference voltage VREF from the driver circuit 202. Further, the PTAT circuit 204 can be configured to output and provide, based on the reference voltage VREF, twelfth and thirteenth control voltages VC12 and VC13 to the first amplifier 206. The PTAT circuit 204 can include the second and third transistors T2 and T3, and the first through third resistors R1-R3.

The first terminals of the first and second resistors R1 and R2 can be coupled with the driver circuit 202. The first terminals of the first and second resistors R1 and R2 can be configured to receive the reference voltage VREF from the driver circuit 202. The first terminals of the second and third transistors T2 and T3 can be coupled with the second terminals of the first and second resistors R1 and R2, respectively. The first terminals of the second and third transistors T2 and T3 can be further coupled with the first amplifier 206. Further, the first terminals of the second and third transistors T2 and T3 can be configured to output and provide the twelfth and thirteenth control voltages VC12 and VC13 to the first amplifier 206, respectively. The second and third terminals of the second transistor T2 can be coupled with the first terminal of the ninth resistor R9 and the ground terminal, respectively. The second and third terminals of the third transistor T3 can be coupled with the first terminal of the tenth resistor R10 and the first terminal of the third resistor R3, respectively. Further, the second terminal of the third resistor R3 can be coupled with the ground terminal. As illustrated in FIG. 2C, the reference voltage VREF can thus be equal to a sum of the thirteenth control voltage VC13 and the voltage drop across the second resistor R2.

The first amplifier 206 can be coupled with the first terminals of the second and third transistors T2 and T3 and the driver circuit 202. The first amplifier 206 can be configured to receive the twelfth and thirteenth control voltages VC12 and VC13 from the first terminals of the second and third transistors T2 and T3, respectively. In an embodiment, the first amplifier 206 receives the twelfth and thirteenth control voltages VC12 and VC13 at the negative and positive input terminals thereof, respectively. Based on the twelfth and thirteenth control voltages VC12 and VC13, the first amplifier 206 can be further configured to generate the eleventh control voltage VC11. The eleventh control voltage VC11 can be greater than a difference between the twelfth and thirteenth control voltages VC12 and VC13. Further, the first amplifier 206 can be configured to provide the eleventh control voltage VC11 to the driver circuit 202 to control the operation of the driver circuit 202. The reference voltage VREF can be thus outputted based on the twelfth and thirteenth control voltages VC12 and VC13 and the supply voltage VDD.

The second amplifier 208 can be coupled with the first terminal of the third transistor T3, the second terminals of the ninth and tenth resistors R9 and R10, and the second voltage divider circuit 212. The second amplifier 208 can be configured to receive the thirteenth control voltage VC13 and a fourteenth control voltage VC14 from the first terminal of the third transistor T3 and the second voltage divider circuit 212, respectively. In an embodiment, the second amplifier 208 receives the thirteenth and fourteenth control voltages VC13 and VC14 at the positive and negative input terminals thereof, respectively. The second amplifier 208 can be further configured to generate a fifteenth control voltage VC15 based on the thirteenth and fourteenth control voltages VC13 and VC14. Further, the second amplifier 208 can be configured to provide the fifteenth control voltage VC15 to the second terminals of the ninth and tenth resistors R9 and R10. The fifteenth control voltage VC15 can be generated to facilitate the compensation of the base-current variations associated with the second and third transistors T2 and T3. Further, the fifteenth control voltage VC15 can be greater than a difference between the thirteenth and fourteenth control voltages VC13 and VC14.

The first terminal of the ninth resistor R9 can be coupled with the second terminal of the second transistor T2, and the second terminal of the ninth resistor R9 can be coupled with the second amplifier 208. In other words, the ninth resistor R9 can be coupled between the second terminal of the second transistor T2 and the second amplifier 208. The second terminal of the ninth resistor R9 can be configured to receive the fifteenth control voltage VC15 from the second amplifier 208. Thus, based on the fifteenth control voltage VC15 and a voltage drop across the ninth resistor R9, the base-current variations associated with the second transistor T2 can be compensated.

The first terminal of the tenth resistor R10 can be coupled with the second terminal of the third transistor T3, and the second terminal of the tenth resistor R10 can be coupled with the second amplifier 208. In other words, the tenth resistor R10 can be coupled between the second terminal of the third transistor T3 and the second amplifier 208. The second terminal of the tenth resistor R10 can be configured to receive the fifteenth control voltage VC15 from the second amplifier 208. Thus, based on the fifteenth control voltage VC15 and a voltage drop across the tenth resistor R10, the base-current variations associated with the third transistor T3 can be compensated.

The second voltage divider circuit 212 can be coupled between the second amplifier 208 and the ground terminal. The second voltage divider circuit 212 can thus be configured to receive the fifteenth control voltage VC15 from the second amplifier 208. Further, the second voltage divider circuit 212 can be configured to output the fourteenth control voltage VC14 such that the fourteenth control voltage VC14 is a scaled down version of the fifteenth control voltage VC15. The second voltage divider circuit 212 can be further configured to provide the fourteenth control voltage VC14 to the second amplifier 208. The second voltage divider circuit 212 can include eleventh and twelfth resistors R11 and R12.

The eleventh resistor R11 has a first terminal that can be coupled with the second amplifier 208. The first terminal of the eleventh resistor R11 can be configured to receive the fifteenth control voltage VC15. The first terminal of the eleventh resistor R11 can be further coupled with the second terminals of the ninth and tenth resistors R9 and R10. The eleventh resistor R11 further has a second terminal that can be coupled with the second amplifier 208. The second terminal of the eleventh resistor R11 can be configured to output and provide the fourteenth control voltage VC14 to the second amplifier 208. The twelfth resistor R12 has a first terminal that can be coupled with the second terminal of the eleventh resistor R11, and a second terminal that can be coupled with the ground terminal. In other words, the twelfth resistor R12 can be coupled between the eleventh resistor R11 and the ground terminal.

Although it is shown that a single resistor (i.e., the twelfth resistor R12) is coupled between the eleventh resistor R11 and the ground terminal, it will be apparent to a person skilled in the art that the scope of the present disclosure is not limited to it. In various other embodiments, a series of two or more resistors can be coupled between the eleventh resistor R11 and the ground terminal, without deviating from the scope of the present disclosure. In such a scenario, a total resistance value of the series of two or more resistors is equal to the resistance value of the twelfth resistor R12. Further, the fourteenth control voltage VC14 can be outputted at any intermediate terminal of the series of two or more resistors.

As illustrated in FIG. 2C, the reference voltage VREF is equal to the sum of the thirteenth control voltage VC13 and the voltage drop across the second resistor R2. The reference voltage VREF can be determined as shown below in equation (25):

$$VREF=VC13+V_{R2} \tag{25}$$

where, $V_{R2}$ is the voltage drop across the second resistor R2.

The second transistor T2, the ninth and tenth resistors R9 and R10, the third transistor T3, and the third resistor R3 form a closed loop. In such a scenario, KVL can be applied as shown below in equation (26):

$$Vbe1+(R9*I_{b1})-(R10*I_{b2})-Vbe2-(R3*I_{R3})=0 \tag{26}$$

where, $I_{b1}$ is the base current associated with the second transistor T2, and $I_{b2}$ is the base current associated with the third transistor T3.

Further, on rearranging equation (26), equation (27) can be obtained as shown below:

$$I_{R3}=\frac{\Delta Vbe}{R3}+\frac{(R9*I_{b1})-(R10*I_{b2})}{R3} \tag{27}$$

As illustrated in FIG. 2C, the current passing through the second resistor R2 can be equal to the difference between the current passing through the third resistor R3 and the base current associated with the third transistor T3. Thus, the current passing through the second resistor R2 can be determined as shown below in equation (28):

$$I_{R2}=I_{R3}-I_{b2} \tag{28}$$

Substituting equation (27) in equation (28), equation (29) can be obtained as shown below:

$$I_{R2}=\frac{\Delta Vbe}{R3}+\frac{(R9*I_{b1})-(R10*I_{b2})}{R3}-I_{b2} \tag{29}$$

Further, on rearranging equation (29), equation (30) can be obtained as shown below:

$$I_{R2}=\frac{\Delta Vbe}{R3}+\frac{(R9*I_{b1})-(R10+R3)*I_{b2}}{R3} \tag{30}$$

The first amplifier 206 is coupled in the negative feedback configuration (i.e., the first amplifier 206, the driver circuit 202, the first and second resistors R1 and R2, and the second and third transistors T2 and T3 form a negative feedback loop). Hence, the first amplifier 206 drives the twelfth and thirteenth control voltages VC12 and VC13 to be equal. Thus, the voltage drop across the second resistor R2 (i.e., the product of the resistance value of the second resistor R2 and the current passing through the second resistor R2) is equal to the voltage drop across the first resistor R1 (i.e., the product of the resistance value of the first resistor R1 and the current passing through the first resistor R1) as shown below in equation (31):

$$I_{R2}*R2=I_{R1}*R1 \tag{31}$$

Further, in the bandgap voltage regulator 104 of the present disclosure, it is assumed that β variations associated with the second and third transistors T2 and T3 are negligible. In other words, the ratio of collector and base currents associated with the second transistor T2 is equal to the ratio of collector and base currents associated with the third transistor T3 as shown below in equation (32):

$$\frac{I_{R2}}{I_{b2}}=\frac{I_{R1}}{I_{b1}} \tag{32}$$

Thus, based on equations (31) and (32), the relation between the base currents associated with the second and third transistors T2 and T3 can be determined as shown below in equation (33):

$$I_{b2}=\frac{R1*I_{b1}}{R2} \tag{33}$$

Further, on substituting equation (33) in equation (30), equation (34) can be obtained as shown below:

$$I_{R2} = \frac{\Delta Vbe}{R3} + \frac{(R9 * I_{b1}) - \left((R10 + R3) * \frac{R1 * I_{b1}}{R2}\right)}{R3} \tag{34}$$

Further, on rearranging equation (34), equation (35) can be obtained as shown below:

$$I_{R2} = \frac{\Delta Vbe}{R3} + I_{b1} * \left(\frac{(R2 * R9) - ((R10 + R3) * R1)}{R3 * R2}\right) \tag{35}$$

Thus, based on equation (35), the voltage drop across the second resistor R2 can be determined as shown below in equation (36):

$$V_{R2} = \frac{R2 * \Delta Vbe}{R3} + I_{b1} * \left(\frac{(R2 * R9) - ((R10 + R3) * R1)}{R3}\right) \tag{36}$$

As illustrated in FIG. 2C, the second amplifier 208 is coupled in a negative feedback configuration (i.e., the second amplifier 208, the ninth and tenth resistors R9 and R10, the second voltage divider circuit 212, and the second and third transistors T2 and T3 form a negative feedback loop). Hence, the second amplifier 208 drives the thirteenth and fourteenth control voltages VC13 and VC14 to be equal. Thus, the thirteenth control voltage VC13 can be determined as shown below in equation (37):

$$VC13 = \frac{R12 * VC15}{R11 + R12} \tag{37}$$

As illustrated in FIG. 2C, the fifteenth control voltage VC15 is equal to a sum of the voltage drop across the ninth resistor R9 and the first base-emitter voltage Vbe1. Thus, the fifteenth control voltage VC15 can be determined as shown below in equation (38):

$$VC15 = Vbe1 + (R9 * I_{b1}) \tag{38}$$

Substituting equation (38) in equation (37), equation (39) can be obtained as shown below:

$$VC13 = \frac{R12 * (Vbe1 + (R9 * I_{b1}))}{R11 + R12} \tag{39}$$

Further, on rearranging equation (39), equation (40) can be obtained as shown below:

$$VC13 = \frac{R12 * Vbe1}{R11 + R12} + \frac{R12 * R9 * I_{b1}}{R11 + R12} \tag{40}$$

Thus, substituting equations (36) and (40) in equation (25), equation (41) can be obtained as shown below:

$$VREF = \frac{R12 * Vbe1}{R11 + R12} + \frac{R12 * R9 * I_{b1}}{R11 + R12} + \frac{R2 * \Delta Vbe}{R3} + I_{b1} * \left(\frac{(R2 * R9) - ((R10 + R3) * R1)}{R3}\right) \tag{41}$$

Further, on rearranging equation (41), equation (42) can be obtained as shown below:

$$VREF = \frac{R12 * Vbe1}{R11 + R12} + \frac{R2 * \Delta Vbe}{R3} + I_{b1} * \left(\frac{R12 * R9}{R11 + R12} + \left(\frac{(R2 * R9) - ((R10 + R3) * R1)}{R3}\right)\right) \tag{42}$$

Based on the resistance values of the first through third resistors R1-R3 and the resistance values of the ninth through twelfth resistors R9-R12, the reference voltage VREF can be outputted such that the reference voltage VREF is independent of base-current variations. Further, the difference between the first and second base-emitter voltages Vbe1 and Vbe2 (i.e., ΔVbe) has a positive temperature co-efficient, whereas the first base-emitter voltage Vbe1 has a negative temperature co-efficient. Thus, based on resistance values of the second, third, eleventh, and twelfth resistors R2, R3, R11, and R12, a temperature-independent reference voltage VREF may be outputted.

The first base-emitter voltage Vbe1 has a negative temperature co-efficient. Thus, at high temperatures (e.g., 425 K), the first base-emitter voltage Vbe1 can be at a lower voltage level as compared to low temperatures (e.g., 233 K). Hence, the thirteenth control voltage VC13 (i.e., the scaled down version of the fifteenth control voltage VC15) can be at a lower voltage level at high temperatures as compared to low temperatures. The thirteenth control voltage VC13 corresponds to a collector voltage associated with the third transistor T3. Therefore, to ensure that the third transistor T3 is operating in an active mode, the thirteenth control voltage VC13 is required to be greater than a collector-emitter saturation voltage associated with the third transistor T3. Thus, the relation between the first base-emitter voltage Vbe1 and the collector-emitter saturation voltage associated with the third transistor T3 can be determined as shown below in equation (43):

$$\frac{R12 * Vbe1_{(TH)}}{R11 + R12} > Vce2_{(sat)(TH)} \tag{43}$$

where, $Vbe1_{(TH)}$ and $Vce2_{(sat)(TH)}$ are the first base-emitter voltage Vbe1 and the collector-emitter saturation voltage associated with the third transistor T3 at a highest temperature (e.g., 425 K), respectively.

In such a scenario, the relation between the reference voltage VREF, the first base-emitter voltage Vbe1, and the collector-emitter saturation voltage associated with the third transistor T3 can be determined as shown below in equation (44):

$$VREF > \left(\frac{Vce2_{(sat)(TH)}}{Vbe1_{(TH)}} * V_{bg0} + V_{R9}\right) \tag{44}$$

where, $V_{bg0}$ is the bandgap voltage at 0 K, and $V_{R9}$ is a voltage drop across the ninth resistor R9.

The lowest voltage level of the reference voltage VREF can thus be determined based on a ratio of the collector-emitter saturation voltage and the first base-emitter voltage Vbe1 at a highest temperature (e.g., 425 K). It will be apparent to a person skilled in the art that the ratio of the collector-emitter saturation voltage and the first base-emitter voltage Vbe1 is less than one. In an embodiment, the lowest voltage level of the reference voltage VREF can be equal to 0.4 volts. In such a scenario, the reference voltage VREF can be in a range of 0.4 volts to 1.23 volts.

Thus, the bandgap voltage regulator 104 can drive the functional circuit 106. The lowest voltage level of the reference voltage VREF is limited by the collector-emitter saturation voltage associated with one of the second and third transistors T2 and T3. As a result, the lowest voltage level of the reference voltage VREF outputted by the bandgap voltage regulator 104 is less than that outputted by a conventional bandgap voltage regulator where the lowest voltage level of the reference voltage is limited by base-emitter voltages of transistors included therein. Further, the compensation of the base-current variations associated with the second and third transistors T2 and T3 results in the bandgap voltage regulator 104 of the present disclosure utilizing a lower voltage level of the supply voltage VDD as compared to that utilized by the conventional bandgap voltage regulator. Hence, the bandgap voltage regulator 104 of the present disclosure can be implemented on SoCs (i.e., the SoC 100) that operate at low supply voltages (e.g., 1 volt), and include functional circuits that require low reference voltages (e.g., 0.4-1.23 volts).

While various embodiments of the present disclosure have been illustrated and described, it will be clear that the present disclosure is not limited to these embodiments only. Numerous modifications, changes, variations, substitutions, and equivalents will be apparent to those skilled in the art, without departing from the spirit and scope of the present disclosure, as described in the claims. Further, unless stated otherwise, terms such as "first" and "second" are used to arbitrarily distinguish between the elements such terms describe. Thus, these terms are not necessarily intended to indicate temporal or other prioritization of such elements.

The invention claimed is:

1. A bandgap voltage regulator, comprising:

a proportional-to-absolute-temperature (PTAT) circuit comprising a plurality of transistors configured to output first and second control voltages, wherein the plurality of transistors include a first transistor and a second transistor, wherein each of the first and second transistors includes first through third terminals and wherein the first terminals of the first and second transistors are configured to output the first and second control voltages, respectively, and wherein the third terminal of the first transistor is coupled with a ground terminal;

a first amplifier that is coupled with the PTAT circuit, and configured to receive a third control voltage and one of the first and second control voltages, and generate a fourth control voltage facilitate compensation of base-current variations associated with the plurality of transistors, wherein the third control voltage is one of (i) a scaled down version of the fourth control voltage, (ii) a scaled down version of a base-emitter voltage associated with the first transistor of the plurality of transistors, and (iii) the base-emitter voltage associated with the first transistor; and a driver circuit configured to receive a supply voltage, receive a fifth control voltage that is generated based on the first and second control voltages, and output a reference voltage, wherein the PTAT circuit further comprises first through third resistors, wherein the first and second resistors are coupled with the driver circuit and configured to receive the reference voltage, wherein the first and second resistors are further coupled with the first terminals of the first and second transistors, respectively, and wherein the third resistor is coupled between the third terminal of the second transistor and the ground terminal.

2. The bandgap voltage regulator of claim 1, further comprising a second amplifier that is coupled with the first transistor, the second transistor, and the driver circuit, and configured to receive the first and second control voltages from the first and second transistors, respectively, and generate and provide the fifth control voltage to the driver circuit.

3. The bandgap voltage regulator of claim 1, wherein the reference voltage is equal to one of (i) a sum of the second control voltage and a voltage drop across the second resistor and (ii) a sum of the first control voltage and a voltage drop across the first resistor.

4. A bandgap voltage regulator, comprising:

a proportional-to-absolute-temperature (PTAT) circuit comprising a plurality of transistors configured to output first and second control voltages, wherein the plurality of transistors include a first transistor and a second transistor, wherein each of the first and second transistors includes first through third terminals and wherein the first terminals of the first and second transistors are configured to output the first and second control voltages, respectively, and wherein the third terminal of the first transistor is coupled with a ground terminal;

a first amplifier that is coupled with the PTAT circuit, and configured to receive a third control voltage and one of the first and second control voltages, and generate a fourth control voltage to facilitate compensation of base-current variations associated with the plurality of transistors, wherein the third control voltage is one of (i) a scaled down version of the fourth control voltage, (ii) a scaled down version of a base-emitter voltage associated with a first transistor of the plurality of transistors, and (iii) the base-emitter voltage associated with the first transistor;

a driver circuit configured to receive a supply voltage, receive a fifth control voltage that is generated based on the first and second control voltages, and output a reference voltage; and a first voltage divider circuit that is coupled between the second terminal of the first transistor and the ground terminal, and configured to output the third control voltage such that the third control voltage is the scaled down version of the base-emitter voltage associated with the first transistor, wherein the first voltage divider circuit is further coupled with the first amplifier, and configured to provide the third control voltage to the first amplifier.

5. The bandgap voltage regulator of claim 4, further comprising:

a first resistor that is coupled between the second terminals of the first and second transistors, wherein the first resistor is further coupled with the first amplifier, and configured to receive the fourth control voltage, and wherein the base-current variations associated with the first and second transistors are compensated based on the fourth control voltage and a voltage drop across the first resistor.

6. The bandgap voltage regulator of claim 4, wherein the first voltage divider circuit comprises:

a second resistor that is coupled with the second terminal of the first transistor and the first amplifier, and configured to output and provide the third control voltage to the first amplifier; and a first set of resistors that is coupled between the second resistor and the ground terminal.

7. A bandgap voltage regulator, comprising:

a proportional-to-absolute-temperature (PTAT) circuit comprising a plurality of transistors configured to output first and second control voltages, wherein each of the first and second transistors includes first through third terminals and wherein the first terminals of the first and second transistors are configured to output the first and second control voltages, respectively, and wherein the third terminal of the first transistor is coupled with a ground terminal;

a first amplifier that is coupled with the PTAT circuit, and configured to receive a third control voltage and one of the first and second control voltages, and generate a fourth control voltage to facilitate compensation of base-current variations associated with the plurality of transistors, wherein the third control voltage is one of (i) a scaled down version of the fourth control voltage, (ii) a scaled down version of a base-emitter voltage associated with a first transistor of the plurality of transistors, and (iii) the base-emitter voltage associated with the first transistor;

a driver circuit configured to receive a supply voltage, receive a fifth control voltage that is generated based on the first and second control voltages, and output a reference voltage;

a sixth resistor that is coupled between the second terminals of the first and second transistors, wherein the sixth resistor is further coupled with the first amplifier, and configured to receive the fourth control voltage, and wherein the base-current variations associated with the first and second transistors are compensated based on the fourth control voltage and a voltage drop across the sixth resistor; and a seventh resistor that is coupled between the second and third terminals of the second transistor, wherein the seventh resistor is further coupled with the first amplifier, and configured to receive the fourth control voltage, and wherein the base-current variations associated with the first and second transistors are further compensated based on a voltage drop across the seventh resistor.

8. A bandgap voltage regulator, comprising:

a proportional-to-absolute-temperature (PTAT) circuit comprising a plurality of transistors configured to output first and second control voltages, wherein each of the first and second transistors includes first through third terminals and wherein the first terminals of the first and second transistors are configured to output the first and second control voltages, respectively, and wherein the third terminal of the first transistor is coupled with a ground terminal;

a first amplifier that is coupled with the PTAT circuit, and configured to receive a third control voltage and one of the first and second control voltages, and generate a fourth control voltage to facilitate compensation of base-current variations associated with the plurality of transistors, wherein the third control voltage is one of (i) a scaled down version of the fourth control voltage, (ii) a scaled down version of a base-emitter voltage associated with a first transistor of the plurality of transistors, and (iii) the base-emitter voltage associated with the first transistor;

a driver circuit configured to receive a supply voltage, receive a fifth control voltage that is generated based on the first and second control voltages, and output a reference voltage;

a first voltage divider circuit that is coupled between the first amplifier and a ground terminal, and configured to:

receive the fourth control voltage from the first amplifier; and output the third control voltage such that the third control voltage is the scaled down version of the fourth control voltage; and provide the third control voltage to the first amplifier.

9. The bandgap voltage regulator of claim 8, further comprising:

a first resistor that is coupled between the second terminal of the first transistor and the first amplifier, and configured to receive the fourth control voltage, wherein the base-current variations associated with the first transistor are compensated based on the fourth control voltage and a voltage drop across the first resistor; and a second resistor that is coupled between the second terminal of the second transistor and the first amplifier, and configured to receive the fourth control voltage, wherein the base-current variations associated with the second transistor are compensated based on the fourth control voltage and a voltage drop across the second resistor.

10. The bandgap voltage regulator of claim 8, wherein the second voltage divider circuit comprises:

a third resistor that is coupled with the first amplifier, and configured to receive the fourth control voltage, and output and provide the third control voltage to the first amplifier; and a first set of resistors that is coupled between the third resistor and the ground terminal.

11. The bandgap voltage regulator of claim 8, wherein the driver circuit is coupled with a functional circuit, and configured to provide the reference voltage to the functional circuit to drive the functional circuit.

12. A system-on-chip (SoC), comprising:

a functional circuit; and a bandgap voltage regulator coupled with the functional circuit, wherein the bandgap voltage regulator comprises:

a proportional-to-absolute-temperature (PTAT) circuit comprising a plurality of transistors configured to output first and second control voltages, wherein the plurality of transistors include a first transistor and a second transistor, wherein each of the first and second transistors includes first through third terminals and wherein the first terminals of the first and second transistors are configured to output the first and second control voltages, respectively;

a first amplifier that is coupled with the PTAT circuit, and configured to receive a third control voltage and one of the first and second control voltages, and generate a fourth control voltage to facilitate compensation of base-current variations associated with the plurality of transistors, wherein the third control voltage is one of (i) a scaled down version of the fourth control voltage, (ii) a scaled down version of a base-emitter voltage associated with the first transistor of the plurality of transistors, and (iii) the base-emitter voltage associated with the first transistor; and a driver circuit that is configured to receive a supply voltage, receive a fifth control voltage that is generated based on the first and second control voltages, and output a reference voltage, wherein the driver circuit is coupled with the functional circuit, and configured to provide the reference voltage to the functional circuit to drive the functional circuit, wherein the PTAT circuit further comprises first through third resistors, wherein the first and second resistors are coupled with the driver circuit and configured to receive the reference voltage, wherein the first and second resistors are further coupled with the first terminals of the first and second transistors, respectively, and wherein the third resistor is coupled between the third terminal of the second resistor and a ground terminal.

13. The SoC of claim 12, wherein the bandgap voltage regulator further comprises a second amplifier that is coupled with the first transistor, the second transistor, and the driver circuit, and configured to receive the first and second control voltages from the first and second transistors, respectively, and generate and provide the fifth control voltage to the driver circuit.

14. The SoC of claim 12, wherein the third terminal of the first transistor is coupled with the ground terminal.

15. The SoC of claim 14, wherein the reference voltage is equal to one of (i) a sum of the second control voltage and a voltage drop across the second resistor and (ii) a sum of the first control voltage and a voltage drop across the first resistor.

16. The SoC of claim 14, wherein the bandgap voltage regulator further comprises:

a fourth resistor that is coupled between the second terminals of the first and second transistors, wherein the fourth resistor is further coupled with the first amplifier, and configured to receive the fourth control voltage, and wherein the base-current variations associated with the first and second transistors are compensated based on the fourth control voltage and a voltage drop across the fourth resistor; and a first voltage divider circuit that is coupled between the second terminal of the first transistor and the ground terminal, and configured to output the third control voltage such that the third control voltage is the scaled down version of the base-emitter voltage associated with the first transistor, wherein the first voltage divider circuit is further coupled with the first amplifier, and configured to provide the third control voltage to the first amplifier.

17. The SoC of claim 14, wherein the bandgap voltage regulator further comprises:

a fifth resistor that is coupled between the second terminals of the first and second transistors, wherein the fifth resistor is further coupled with the first amplifier, and configured to receive the fourth control voltage, and wherein the base-current variations associated with the first and second transistors are compensated based on the fourth control voltage and a voltage drop across the fifth resistor; and a sixth resistor that is coupled between the second and third terminals of the second transistor, wherein the sixth resistor is further coupled with the first amplifier, and configured to receive the fourth control voltage, and wherein the base-current variations associated with the first and second transistors are further compensated based on a voltage drop across the sixth resistor.

18. The SoC of claim 14, wherein the bandgap voltage regulator further comprises:

a seventh resistor that is coupled between the second terminal of the first transistor and the first amplifier, and configured to receive the fourth control voltage, wherein the base-current variations associated with the first transistor are compensated based on the fourth control voltage and a voltage drop across the seventh resistor;

an eighth resistor that is coupled between the second terminal of the second transistor and the first amplifier, and configured to receive the fourth control voltage, wherein the base-current variations associated with the second transistor are compensated based on the fourth control voltage and a voltage drop across the eighth resistor; and a second voltage divider circuit that is coupled between the first amplifier and the ground terminal, and configured to receive the fourth control voltage from the first amplifier, output the third control voltage such that the third control voltage is the scaled down version of the fourth control voltage, and provide the third control voltage to the first amplifier.

* * * * *